US005252535A

United States Patent [19]

Martin et al.

[11] Patent Number: 5,252,535

[45] Date of Patent: Oct. 12, 1993

[54] THERMAL DYE TRANSFER RECEIVING ELEMENT WITH ANTISTAT BACKING LAYER

[75] Inventors: Thomas W. Martin, Rochester; Wayne A. Bowman, Walworth, both of N.Y.

[73] Assignee: Eastman Kodak Company, Rochester, N.Y.

[21] Appl. No.: 995,450

[22] Filed: Dec. 23, 1992

[51] Int. Cl.[5] ..... B41M 5/035

[52] U.S. Cl. ..... 503/227; 8/471; 428/195; 428/206; 428/211; 428/327; 428/331; 428/913; 428/914

[58] Field of Search ..... 8/471; 428/195, 913, 428/914, 206, 211, 327, 331; 503/227

[56] References Cited

U.S. PATENT DOCUMENTS

| | | | |
|---|---|---|---|
| 4,814,321 | 3/1989 | Campbell | 503/227 |
| 4,820,686 | 4/1989 | Ito et al. | 503/227 |
| 4,828,971 | 5/1989 | Przezdziecki | 430/531 |
| 5,011,814 | 4/1991 | Harrison | 428/195 |
| 5,075,164 | 12/1991 | Bowman et al. | 428/325 |
| 5,093,309 | 3/1992 | Hart et al. | 503/227 |
| 5,096,875 | 3/1992 | Martin | 428/195 |
| 5,198,408 | 3/1993 | Martin | 503/227 |

FOREIGN PATENT DOCUMENTS

| | | | |
|---|---|---|---|
| 1-47586 | 2/1989 | Japan | 117/36 |

*Primary Examiner*—Pamela R. Schwartz
*Attorney, Agent, or Firm*—Andrew J. Anderson

[57] ABSTRACT

A dye-receiving element for thermal dye transfer includes a support having on one side thereof a polymeric dye image-receiving layer and on the other side thereof a backing layer wherein the backing layer comprises a mixture of an ionic polymer as a polymeric binder comprising an addition product of from about 0 to 98 mol percent of an alkyl methacrylate wherein the alkyl group has from 1 to 12 carbon atoms, from about 0 to 98 mol percent of a vinylbenzene, and from about 2 to 12 mol percent of an alkali metal salt of an ethylenically unsaturated sulfonic or carboxylic acid, the polymer components being selected to achieve a glass transition temperature of at least about 30° C. for the resulting polymer; submicron colloidal inorganic particles; and polymeric particles of a size larger than the inorganic particles.

20 Claims, No Drawings

THERMAL DYE TRANSFER RECEIVING ELEMENT WITH ANTISTAT BACKING LAYER

This invention relates to dye-receiving elements used in thermal dye transfer, and more particularly to the backing layer of such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye receiving elements for thermal dye transfer generally include a transparent or reflective support bearing on one side thereof a dye image-receiving layer and on the other side thereof a backing layer. As set forth in U.S. Pat. Nos. 5,011,814 and 5,096,875, the disclosures of which are incorporated by reference, the backing layer material is chosen to (1) provide adequate friction to a thermal printer rubber pick roller to allow for removal of one receiver element at a time from a thermal printer receiver element supply stack, (2) minimize interactions between the front and back surfaces of receiving elements such as dye retransfer from one imaged receiving element to the backing layer of an adjacent receiving element in a stack of imaged elements, and (3) minimize sticking between a dye-donor element and the receiving element backing layer when the receiving element is accidentally inserted into a thermal printer wrong side up.

Additionally, especially for transparent receiving elements (e.g., elements used for printing overhead transparencies, the supports of which generally comprise smooth polymeric films), static charges may be easily generated upon transport of the elements through a thermal printer. As such, it is preferable for the backing layer (or an additional layer) to provide sufficient surface conductivity to dissipate such charges. Also, the backing layer for transparent elements must itself be transparent.

One transparent backing antistat layer which has found use for dye-receiving elements is a mixture of polyvinyl alcohol cross-linked with VOLAN (an organo-chromic chloride from DuPont), potassium chloride, poly(methyl methacrylate) beads (3–5μm), and Saponin (surfactant coating aid from Eastman Kodak). This backing layer has excellent clarity and functions well to minimize interactions between the front and back surfaces of receiving elements. This backing layer also provides adequate friction to a rubber pick roller to allow removal of one receiving element at a time from a stack. This backing layer, however, may stick to a dye-donor element at high printer head voltages when the receiving element is used wrong side up, and does not provide as high a level of surface conductivity as may be desired to dissipate charges generated upon transport of the elements through a thermal printer. While additional ionic antistat agents may be added to the layer, such additional agents may adversely affect the clarity of the backing layer.

U.S. Pat. Nos. 5,011,814 and 5,096,875 referred to above and U.S. Pat. No. 5,198,408, the disclosure of which is also incorporated by reference, disclose backing layers for dye-receiving elements comprising various mixtures of submicron colloidal inorganic particles, polymeric particles of a size larger than the inorganic particles, and polymeric binders such as polyethylene oxide and polyvinyl alcohol. While ionic antistat agents may also be added to such backing layers to increase the level of surface conductivity in order to dissipate charges generated upon transport of the elements through a thermal printer, such additional agents may adversely affect the clarity of the backing layer if added at a level high enough to achieve the desired surface conductivity.

It would be desirable to provide a transparent backing layer for a dye-receiving element which would minimize interactions between the front and back surfaces of such elements, provide adequate friction to a thermal printer rubber pick roller to allow for removal of receiver elements one at a time from a receiver element supply stack, minimize sticking to a dye-donor element, and provide sufficient surface conductivity to dissipate charges generated upon transport of the elements through a thermal printer.

These and other objects are achieved in accordance with this invention which comprises a dye-receiving element for thermal dye transfer comprising a support having on one side thereof a polymeric dye image-receiving layer and on the other side thereof a backing layer, wherein the backing layer comprises a mixture of an ionic polymer as a polymeric binder comprising an addition product of from about 0 to 98 mol percent of an alkyl methacrylate wherein the alkyl group has from 1 to 12 carbon atoms, from about 0 to 98 mol percent of a vinylbenzene, and from about 2 to 12 mol percent of an alkali metal salt of an ethylenically unsaturated sulfonic or carboxylic acid, the polymer components being selected to achieve a glass transition temperature of at least about 30° C. for the resulting polymer; submicron colloidal inorganic particles; and polymeric particles of a size larger than the inorganic particles.

The process of forming a dye transfer image in a dye-receiving element in accordance with this invention comprises removing an individual dye-receiving element as described above from a supply stack of dye-receiving elements, moving the individual receiving element to a thermal printer printing station and into superposed relationship with a dye-donor element comprising a support having thereon a dye-containing layer so that the dye-containing layer of the donor element faces the dye image-receiving layer of the receiving element, and imagewise heating the dye-donor element thereby transferring a dye image to the individual receiving element. The process of the invention is applicable to any type of thermal printer, such as a resistive head thermal printer, a laser thermal printer, or an ultrasound thermal printer.

In a preferred embodiment of the invention, the dye receiving element is a transparent element, and the backing layer comprises a mixture of 50 to 70 wt. % of the above described ionic polymer, 10 to 20 wt. % polyethylene oxide as an additional polymeric binder, 15 to 30 wt. % submicron colloidal inorganic particles of a size from 0.01 to 0.05 μm, and 0.5 to 8.5 wt. % polymeric particles of a size from 3 to 5 μm.

The alkyl methacrylate portion of the ionic polymer used in the backing layer of the invention may be any suitable alkyl methacrylate having from 1 to 12 carbon atoms in the alkyl group. Preferably, the alkyl group of the alkyl methacrylate has from 3 to 8 carbon atoms, such as n-propyl methacrylate, isopropyl methacrylate, n-butyl methacrylate, n-pentyl methacrylate, 2-methyl butyl methacrylate, 2-dimethyl propyl methacrylate, hexyl methacrylate, 2-methyl pentyl methacrylate, 2-4-dimethyl butyl methacrylate, heptyl methacrylate, 2-methyl hexyl methacrylate, octyl methacrylate, 4-methyl heptyl methacrylate and the like. It is preferred to use alkyl methacrylates which have 3 to 8 carbon atoms in the alkyl group, more preferably butyl methacrylate, as these materials have a strong influence on the Tg of the latex polymer and thereby the blocking characteristics of the binder and the coating characteristics of the coating composition. The alkyl methacrylate preferably is used in an amount of from about 20 to 70 mol percent of the ionic polymer.

The vinylbenzene portion of the ionic polymer used in the backing layer of the invention may be, for example, styrene or substituted styrene monomers. While styrene itself is preferred, other vinylbenzene monomers such as vinyltoluene, p-ethylstyrene, p-tert-butylstyrene, and the like may be employed. Further, the alkylene portion may also be substituted by an alkyl group such as a methyl group, an ethyl group and the like such as alpha-methylstyrene. The vinylbenzene preferably is used in an amount of from about 20 to 70 mol percent of the ionic polymer.

Any suitable alkali metal salt of an ethylenically unsaturated sulfonic acid or carboxylic acid may be employed in the ionic polymers in accordance with the invention such as, for example, the sodium, potassium and lithium salts of sulfoethyl methacrylate, the sodium, potassium and lithium salts of acrylic acid and methacrylic acid, the sodium, potassium and lithium salts of styrenesulfonic acid, sodium 2-acrylamido-2-methylpropanesulfonic acid, the potassium salt of 3-acrylamido-3-methylbutenoic acid, the lithium salt of para-vinylbenzoic acid, and the like. This ionic monomer is utilized in an amount of from about 2 to 12 mol percent, more preferably from about 4 to 8 mol percent, in order to render the polymer compatable with the other backing layer ingredients and to provide sufficient ionic characteristic to the polymer to improve the surface conductivity of the backing layer.

The components of the ionic polymer are selected to achieve a glass transition temperature (Tg) of at least about 30° C. Preferably, the Tg of the ionic polymer is from about 30° C. to 120° C., more preferably from about 40° C. to 95° C. The ionic polymer employed in the invention is preferably of a molecular weight of from about 100,000 to 500,000. The ionic polymer may be synthesized by conventional polymerization techniques, such as described in the examples of U.S. Pat. No. 5,075,164, the disclosure of which is incorporated by reference.

Other polymeric binders may be used in combination with the ionic polymer binder. In one embodiment of the invention, e.g., a backing layer polymeric binder combination of the ionic polymer and polyethylene oxide is preferably used for the feature of avoiding sticking of the donor to the receiver backing layer if the receiver is accidentally inserted wrong side up in a thermal printer. Preferably, the total amount of polymeric binder comprises from about 20 to 85 wt. % of the backing layer, with at least about one-half, preferably at least about two-thirds, of the polymeric binder by weight being the ionic polymer.

The submicron colloidal inorganic particles preferably comprise from about 10 to about 80 wt. % of the backing layer mixture of the invention. While any submicron colloidal inorganic particles may be used, the particles preferably are water-dispersible and less than 0.1 μm in size, and more preferably from about 0.01 to 0.05 μm in size. There may be used, for example, silica, alumina, titanium dioxide, barium sulfate, etc. In a preferred embodiment, silica particles are used.

The polymeric particles may in general comprise any organic polymeric material, and preferably comprise from about 0.2 to 30 wt. % of the backing layer mixture. Inorganic particles are in general too hard and are believed to dig into the receiving layer of adjacent receiver elements in a supply stack, preventing such particles from effectively controlling the sliding friction between adjacent receiver elements. Particularly preferred polymeric particles are cross-linked polymers such as polystyrene cross-linked with divinylbenzene, and fluorinated hydrocarbon polymers. The polymeric particles are preferably from about 1 μm to about 15 μm in size, more preferably from about 3 μm to 12 μm.

Adding a polymeric particulate material of the indicated size decreases the sliding friction between adjacent receiving elements in a supply stack to a greater extent than the picking friction between the backing layer and a rubber pick roller. As a result, blocking or multiple feeding is controlled while adequate picking friction is maintained. Using the ionic polymer in the backing layer mixture results in maintaining adequate friction between the rubber pick roller and the backing layer even under high temperature and relative humidity conditions, while helping to provide sufficient surface conductivity to dissipate electrical charges.

Additional materials may also be added to the backing layer. For example, surfactants and other conventional coating aids may also be used in the backing layer coating mixture. For transparencies, the addition of an ionic antistat agent to the backing layer, such as potassium chloride, vanadium pentoxide, or others known in the art, is desirable. The backing layers of the invention, however, provide the advantage of minimizing the amount of ionic antistat agent which must be added to provide a desired level of surface conductivity.

The backing layer of the invention may be present in any amount which is effective for the intended purpose. In general, good results have been obtained at a total coverage of from about 0.1 to about 2.5 g/m$^2$.

The support for the dye-receiving element of the invention may be transparent or opaque, and may be, for example, a polymeric, a synthetic paper, or a cellulosic paper support, or laminates thereof. In a preferred embodiment, a transparent support is used. Examples of transparent supports include films of poly(ether sulfone(s)), polyimides, cellulose esters such as cellulose acetate, poly(vinyl alcohol-co-acetal(s)), and poly(ethylene terephthalate). The support may be employed at any desired thickness, usually from about 10 μm to 1000 μm. Additional polymeric layers may be present between the support and the dye image-receiving layer. In addition, subbing layers may be used to improve adhesion of the dye image-receiving layer and backing layer to the support.

For thermal dye-transfer transparency receivers (e.g., those designed for transmission viewing and having a transparent film support), lower total backing layer coverages of from about 0.1 to about 0.6 g/m$^2$ are preferred. Backing layer coverages greater than 0.6 g/m$^2$ tend to have too much haze for transparency applications. For these backing layers, the total amount of polymeric binder preferably comprises from about 50 to 85 wt.% of the backing layer, and a total polymeric binder coverage of about 0.05 to 0.45 g/m$^2$ is preferred. Additionally, at least about three-fourths of the polymer weight should be the ionic polymer. An especially preferred polymer coverage is the ionic polymer and polyethylene oxide at about 0.06 g/m$^2$ and 0.02 g/m$^2$ respectively. The total polymer coverage is more preferably maintained below 0.25 g/m$^2$ to avoid haze. Also for transparency receivers, the submicron colloidal inorganic particles preferably comprise from about 10 to 40 wt. %, more preferably 15 to 30 wt. %, of the backing layer mixture, and the larger polymeric particles preferably are from about 3 μm to about 5 μm in size and comprise from about 0.2 to 10 wt. %, more preferably 0.5 to 8.5 wt. %, of the backing layer mixture.

The dye image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at from about 1 to about 10 g/m$^2$. An overcoat layer may be further coated over the dye-receiving layer, such as described in U.S. Pat. No. 4,775,657, the disclosure of which is incorporated by reference.

Conventional dye-donor elements may be used with the dye-receiving element of the invention. Such donor elements generally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly (ethylene terephthalate) support coated with sequential repeating areas of cyan, magenta and yellow dye, and the dye transfer process steps are sequentially performed for each color to obtain a three-color dye transfer image.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer, such as laser or ultrasound, may be used.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

EXAMPLE 1

Dye-receiver backing layers were prepared by coating the following layers in order on the backside of a 175 μm thick transparent poly(ethylene terephthalate) support:

(1) Subbing layer of poly(acrylonitrile-co-vinylidene chloride-co acrylic acid) (14:79:7 wt. ratio) (0.06 g/m$^2$) coated from butanone solvent.

(2) Aqueous dispersion of backing layer.

The backing layers contained an ionic polymer according to the invention, colloidal silica (LUDOX AM alumina modified colloidal silica of duPont) of approximately 0.014 μm diameter, polystyrene beads cross-linked with m- and p-divinylbenzene of 3–5 μm average diameter, polyethylene oxide, Triton X200E (a sulfonated aromatic-aliphatic surfactant of Rohm and Haas), and APG-225 (an alkyl polyglycoside surfactant of Henkel Industries).

The following backing layers were prepared:

| Invention Backing Layer E-1: | |
|---|---|
| Styrene/2-sulfoethyl methacrylate Na salt (95:5 mole ratio copolymer, Tg = 93° C.) | 0.065 g/m$^2$ |
| Polyethyleneoxide #343 (a polyethylene oxide of mw 900,000) (Scientific Polymer Products) | 0.022 g/m$^2$ |
| Ludox AM | 0.027 g/m$^2$ |
| Polystyrene beads | 0.0027 g/m$^2$ |
| Potassium chloride | 0.0075 g/m$^2$ |
| Triton X200E | 0.0022 g/m$^2$ |
| APG-225 | 0.0022 g/m$^2$ |

Invention Backing Layer E-2:As E-1 except 0.019 g/m$^2$ Polyethyleneoxide #343 was used.

Invention Backing Layer E-3:As E-1 except Polyethyleneoxide #344 (Scientific Polymer Products) (mw 4,000,000)(0.019 g/m$^2$) was used in place of Polyethyleneoxide #343.

| Invention Backing Layer E-4: | |
|---|---|
| Styrene/2-sulfoethyl methacrylate Na salt (95:5 mole ratio copolymer) | 0.38 g/m$^2$ |
| Polyethyleneoxide #136D (Scientific Polymer Products, a polyethylene oxide of mw 300,000) | 0.054 g/m$^2$ |
| Ludox AM | 0.11 g/m$^2$ |
| Polystyrene beads | 0.0027 g/m$^2$ |
| Potassium chloride | 0.0075 g/m$^2$ |
| Triton X200E | 0.0022 g/m$^2$ |
| APG-225 | 0.0022 g/m$^2$ |

Invention Backing Layer E-5:As E-4 except 0.065 g/m$^2$ Polyethyleneoxide #136D was used.

Invention Backing Layer E-6:As E-4 except 0.075 g/m$^2$ Polyethyleneoxide #136was used.

Invention Backing Layer E-7:As E-4 except styrene/n-butyl methacrylate/2-sulfoethyl methacrylate Na salt (65:30:5 mole ratio copolymer, Tg=66° C.) (0.38 g/m$^2$ ) was used in place of the styrene/2-sulfoethyl methacrylate Na salt 95:5 mole ratio copolymer.

Invention Backing Layer E-8:As E-7 except 0.065 g/m$^2$ Polyethyleneoxide #136D was used.

Invention Backing Layer E-9:As E-7 except 0.075 g/m$^2$ Polyethyleneoxide #136D was used.

Invention Backing Layer E-10:As E-3 except Daxad-30 (sodium polymethacrylate of W. R. Grace Chem. Co.) (0.0022 g/m$^2$) was used in place of the APG-225 surfactant.

Invention Backing Layer E-11:As E-3 except poly(-methyl methacrylate) beads of 3-5 μm average diameter (0.0075 g/m$^2$) were used in place of the cross-linked polystyrene beads.

| Invention Backing Layer E-12: | |
|---|---|
| Styrene/n-butyl methacrylate/ 2-sulfoethyl methacrylate Na salt (35:60:5 mole ratio copolymer, Tg = 45° C.) | 0.22 g/m$^2$ |
| Polyox WSRN-10 (Union Carbide) (a polyethyleneoxide of mw 100,000) | 0.054 g/m$^2$ |
| Ludox AM | 0.11 g/m$^2$ |
| Polystyrene beads | 0.0027 g/m$^2$ |
| Potassium chloride | 0.0075 g/m$^2$ |
| Triton X200E | 0.0022 g/m$^2$ |
| APG-225 | 0.0022 g/m$^2$ |

Invention Backing Layer E-13:As E-12 except styrene/n-butyl methacrylate/2-sulfoethyl methacrylate Na salt (50:45:5 mole ratio copolymer, Tg =50° C.)(0.22 g/m$^2$) was used in place of the 35:60:5 mole ratio styrene/n-butyl methacrylate/2-sulfoethyl methacrylate Na salt copolymer.

Invention Backing Layer E-14:As E-12 except n-butyl methacrylate/2-sulfoethyl methacrylate Na salt (95:5 mole ratio copolymer, Tg =35° C.)(0.22 g/m$^2$) was used in place of the 35:60:5 mole ratio styrene/n-butyl methacrylate/2-sulfoethyl methacrylate Na salt copolymer.

A control backing layer was also similarly prepared and coated:

| Control Backing Layer C-1: | |
|---|---|
| Elvanol 71-30 (DuPont)(polyvinyl alcohol) | 0.081 g/m$^2$ |
| Ludox AM | 0.065 g/m$^2$ |
| Volan (DuPont)(an organo-chromic chloride) | 0.016 g/m$^2$ |
| Poly(methyl methacrylate) beads (3-5 μm average diameter) | 0.0065 g/m$^2$ |
| Potassium chloride | 0.0081 g/m$^2$ |

-continued

| Control Backing Layer C-1: | |
|---|---|
| Saponin (Eastman Kodak Co.) | 0.0016 g/m$^2$ |

To evaluate receiver backing layer to rubber pick roller friction, each dye receiver tested was placed face down (backing layer side up) on top of a stack of face down receivers. Two pick rollers (12 mm wide and 28 mm in diameter with an outer 2 mm layer of Kraton G2712X rubber) of a commercial thermal printer (Kodak SV6500 Color Video Printer) were lowered onto the top test receiver so as to come into contact with the backing layer to be tested. The rollers were stalled at a fixed position so that they could not rotate, and supplied a normal force of approximately 4 N (400 g) to the receiver backing layer. A spring type force scale (Chatillon 2 kg×26 scale) was attached to the test receiver and was used to pull it at a rate of 0.25 cm/sec from the receiver stack. The required pull forces for the various backing layers were measured at low (30% RH) and high humidity (90% RH) as the receivers began to slide and are indicated in Table I below. In actual practice, it has been found that pull forces of at least about 6 N (600 g) or more are preferable to ensure good picking reliability.

In a separate experiment, backing layers were tested for sticking of the donor to the receiver when the receiver is inserted for printing "wrong side up" in a resistive head thermal printer. The degree of sticking is monitored by passing a coated sheet with the backing layer in contact with a dye donor sheet similar to those described in U.S. Pat. Nos. 4,916,112, 4,927,803 and 5,023,228 through a print cycle at a series of print head voltages. Voltage to sticking set forth in the Table I is the head voltage at which the donor ribbon and antistat layer begin to fuse together and stick.

Clarity values presented in Table I are visual assessments. Excellent indicates transparent similar to window glass. Good indicates slight haze. Moderate indicates a low, acceptable level of haze.

Surface resistivity values presented in Table I were measured at 20° C., 50% RH.

TABLE I

| Backing Layer | Clarity | Voltage to Stick | Picking Friction (Newtons) 30% RH | Picking Friction (Newtons) 90% RH | Surface Resistance (× 10$^{12}$ Ohm/cm$^2$) |
|---|---|---|---|---|---|
| C-1 | Excellent | 11.25 | 7.9 | 7.5 | 50.1 |
| E-1 | Excellent | 15.0 | 7.8 | 6.8 | 1.30 |
| E-2 | Excellent | 15.0 | 7.8 | 7.4 | 1.25 |
| E-3 | Excellent | 15.0 | 8.0 | 7.8 | 0.63 |
| E-4 | Good | 16.5 | 7.5 | 6.6 | 0.21 |
| E-5 | Good | 16.5 | 7.6 | 7.0 | 0.07 |
| E-6 | Good | 16.5 | 8.4 | 6.6 | 0.05 |
| E-7 | Good | 16.5 | 7.7 | 6.5 | 0.29 |
| E-8 | Good | 16.5 | 7.8 | 6.6 | 0.14 |
| E-9 | Good | 16.5 | 8.0 | 6.7 | 0.10 |
| E-10 | Excellent | 14.5 | 8.4 | 7.7 | 2.88 |
| E-11 | Excellent | 14.5 | 8.0 | 7.1 | 2.22 |
| E-12 | Moderate | 14.0 | 7.8 | 7.0 | 1.56 |
| E-13 | Good | 14.25 | 7.8 | 7.4 | 0.08 |
| E-14 | Good | 14.25 | 8.0 | 7.8 | 0.32 |

The data above show that the backing layers of the invention have excellent picking friction characteristics, have generally good to excellent clarity, and provide greater surface conductivity (lower surface resistance)

and improved resistance to sticking relative to the comparison backing layer.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a support having on one side thereof a polymeric dye image-receiving layer and on the other side thereof a backing layer, the improvement wherein the backing layer comprises a mixture of an ionic polymer as a polymeric binder comprising an addition product of from about 0 to 98 mol percent of an alkyl methacrylate wherein the alkyl group has from 1 to 12 carbon atoms, from about 0 to 98 mol percent of a vinylbenzene, and from about 2 to 12 mol percent of an alkali metal salt of an ethylenically unsaturated sulfonic or carboxylic acid, the polymer components being selected to achieve a glass transition temperature of at least about 30° C. for the resulting polymer; submicron colloidal inorganic particles; and polymeric particles of a size larger than the inorganic particles.

2. The element of claim 1, wherein the total coverage of the backing layer is from 0.1 to 2.5 $g/m^2$.

3. The element of claim 1, wherein the backing layer further comprises polyethylene oxide as a polymeric binder in an amount by weight up to one half the total polymeric binder.

4. The element of claim 3, wherein said support is transparent and wherein the ionic polymer and polyethylene oxide are present in the backing layer in a ratio of at least about 3:1 and a total coverage of about 0.05 to 0.45 $g/m^2$.

5. The element of claim 4, wherein the total coverage of the backing layer is from 0.1 to 0.6 $g/m^2$.

6. The element of claim 1, wherein the support is transparent and the total coverage of the backing layer is from 0.1 to 0.6 $g/m^2$.

7. The element of claim 1, wherein the ionic polymer has a glass transition temperature of from about 30° to 120° C.

8. The element of claim 1, wherein the ionic polymer is comprised of from about 20 to 70 mol percent of the alkyl methacrylate and from about 20 to 70 mol percent of the vinylbenzene.

9. The element of claim 1, wherein the ionic polymer is comprised of from about 4 to 8 mol percent of the alkali metal salt of an ethylenically unsaturated sulfonic or carboxylic acid.

10. A dye-receiving element for thermal dye transfer comprising a support having on one side thereof a polymeric dye image-receiving layer and on the other side thereof a backing layer, wherein said backing layer comprises a mixture of an ionic polymer as a polymeric binder comprising an addition product of from about 0 to 98 mol percent of an alkyl methacrylate wherein the alkyl group has from 1 to 12 carbon atoms, from about 0 to 98 mol percent of a vinylbenzene, and from about 2 to 12 mol percent of an alkali metal salt of an ethylenically unsaturated sulfonic or carboxylic acid, the polymer components being selected to achieve a glass transition temperature of at least about 30° C. for the resulting polymer; polyethylene oxide as an additional polymeric binder; 10 to 80 wt. % submicron colloidal inorganic particles of a size from 0.01 to 0.05 μm and 0.2 to 30 wt. % polymeric particles of a size from 1 to 15 μm, the total amount of polymeric binder comprising from about 20 to 80 wt. % of the backing layer and the ionic polymer comprising at least one half of the total amount of polymeric binder by weight.

11. The element of claim 10, wherein the support is transparent and the total coverage of the backing layer is from 0.1 to 0.6 $g/m^2$.

12. The element of claim 10, wherein the support is transparent and the backing layer comprises a mixture of 50 to 70 wt. % of the ionic polymer, 10 to 20 wt. % polyethylene oxide, 15 to 30 wt. % submicron colloidal inorganic particles of a size from 0.01 to 0.05 μm, and 0.5 to 8.5 wt. % polymeric particles of a size from 3 to 5 μm.

13. In a process of forming a dye transfer image in a dye-receiving element comprising:

(a) removing an individual dye-receiving element comprising a support having on one side thereof a polymeric dye image-receiving layer and on the other side thereof a backing layer from a stack of dye-receiving elements;

(b) moving said individual dye-receiving element to a thermal printer printing station and into superposed relationship with a dye-donor element comprising a support having thereon a dye-containing layer so that the dye-containing layer of the donor element faces the dye image-receiving layer of the receiving element; and (c) imagewise-heating said dye-donor element and thereby transferring a dye image to said individual dye-receiving element;

the improvement wherein the backing layer comprises a mixture of an ionic polymer as a polymeric binder comprising an addition product of from about 0 to 98 mol percent of an alkyl methacrylate wherein the alkyl group has from 1 to 12 carbon atoms, from about 0 to 98 mol percent of a vinylbenzene, and from about 2 to 12 mol percent of an alkali metal salt of an ethylenically unsaturated sulfonic or carboxylic acid, the polymer components being selected to achieve a glass transition temperature of at least about 30° C. for the resulting polymer; submicron colloidal inorganic particles; and polymeric particles of a size larger than the inorganic particles.

14. The process of claim 13, wherein the total coverage of the backing layer is from 0.1 to 2.5 $g/m^2$.

15. The process of claim 13, wherein the backing layer further comprises polyethylene oxide as a polymeric binder in an amount by weight up to one half the total polymeric binder.

16. The process of claim 15, wherein said dye-receiving element support is transparent and wherein the ionic polymer and polyethylene oxide are present in the backing layer in a ratio of at least about 3:1 and a total coverage of about 0.05 to 0.45 $g/m^2$.

17. The process of claim 16, wherein the total coverage of the backing layer is from 0.1 to 0.6 $g/m^2$.

18. The process of claim 13, wherein the ionic polymer is comprised of from about 4 to 8 mol percent of the alkali metal salt of an ethylenically unsaturated sulfonic or carboxylic acid.

19. The process of claim 13, wherein the dye-receiving element support is transparent and the backing layer comprises a mixture of 50 to 70 wt. % of the ionic polymer, 10 to 20 wt. % polyethylene oxide, 15 to 30 wt. % submicron colloidal inorganic particles of a size from 0.01 to 0.05 μm, and 0.5 to 8.5 wt. % polymeric particles of a size from 3 to 5 μm.

20. The process of claim 13, wherein the dye-receiving element support is transparent and the total coverage of the backing layer is from 0.1 to 0.6 $g/m^2$.

* * * * *